US005217153A

United States Patent [19]

Yamamoto et al.

[11] Patent Number: 5,217,153

[45] Date of Patent: Jun. 8, 1993

[54] DRIVING MACHINE HAVING CYLINDER FIXING ARRANGEMENT

[75] Inventors: Kunio Yamamoto; Kaoru Ichikawa, both of Katsuta, Japan

[73] Assignee: Hitachi Koki Co., Ltd., Tokyo, Japan

[21] Appl. No.: 964,440

[22] Filed: Oct. 21, 1992

[51] Int. Cl.[5] ..... B25C 5/13

[52] U.S. Cl. ..... 227/130

[58] Field of Search ..... 227/130, 107; 173/116

[56] References Cited

U.S. PATENT DOCUMENTS

| | | | |
|---|---|---|---|
| 3,055,344 | 9/1962 | Fisher | 227/130 |
| 3,601,300 | 8/1971 | Anstett | 227/130 |
| 3,673,922 | 7/1972 | Doyle | 227/130 |
| 4,523,646 | 6/1985 | Doyle et al. | 227/130 |
| 4,667,572 | 5/1987 | Elliesen | 227/130 |
| 4,932,480 | 6/1990 | Golsch | 227/130 |

*Primary Examiner*—Douglas D. Watts
*Assistant Examiner*—Scott A. Smith
*Attorney, Agent, or Firm*—Sughrue, Mion, Zinn, Macpeak & Seas 7 Claims, 2 Drawing Sheets

DRIVING MACHINE HAVING CYLINDER FIXING ARRANGEMENT

BACKGROUND OF THE INVENTION

The present invention relates to a driving machine, and more particularly to the driving machine having a cylinder fixing arrangement for improving the ease with which a cylinder can be removed and reinserted.

As per FIG. 1, a conventional driving machine includes an outer body frame 1 defining therein an internal accumulator chamber 2 where compressed air is accumulated. In the body frame 1 there are provided a cylinder 8 having a flange 8*a*, a piston 5 reciprocally movable in the cylinder 8, and a head valve 6 involved in returning the reciprocating piston 5 to its initial position to complete each stroke cycle. An ejector 3 is provided at an end of one stroke of the piston 5 and in which a fastener 4 such as a nail is positioned. Further, a trigger valve 7 is provided for opening and closing the head valve 6. An air chamber S is defined by a space below the flange 8*a* of the cylinder 8 and in between the body 1 and an outer peripheral surface of the cylinder 8 for returning the piston 5 to its initial position.

As shown in FIGS. 2 and 3, the body frame 1 is formed with an internal annular groove 1*a*. Further, a stop washer 9 rests on an upper surface of the flange 8*a* and is engaged with the annular groove 1*a* in order to prevent the cylinder 8 from moving axially upward. The stop washer 9 has inwardly bent end lip portions 9*a* extending radially inwardly for changing a diameter of the resultant washer 9 by pinching the lip portions 9*a* together.

The accumulator chamber 2 must be isolated from the air chamber S. To this effect, the flange 8*a* mates with a sealing area 1*b* of the body frame 1, and an O-ring 10 is installed in an annular groove 8*d* of the flange 8*a*. The stop washer 9 is made from a resilient material and is fitted to about one half its radial width into the groove 1*a*. The remaining portion of the stop washer 9, which radially inwardly projects from the groove 1*a*, rests on the upper surface of the flange 8*a*. (It should be noted that the upper surface of the flange 8*a* is in alignment with a lower wall of the annular groove 1*a*). By making use of radially outward self expansion force of the stop washer 9, the stop washer 9 can be held in the given position.

The inner peripheral surface portion of the body frame 1 is provided with a fixing region 1*c* at a position above the sealing area 1*b*. An inner diameter of the fixing region 1*c* is made equal to an inner diameter of the sealing area 1*b* so as to prevent upward movement of the stop washer 9, thus preventing upward movement of the cylinder 8.

When such conventional driving machine drives or ejects the fastener 4 into a workpiece, the opposite reaction to the action of the piston forces the cylinder 8 upwards in the direction opposite to the movement of the piston 5. Because the flange 8*a* is connected to the cylinder 8, the flange 8*a* also moves upward. Because the stop washer 9 rests on the upper surface of the flange 8*a*, the stop washer 9 is pushed upwards as the flange 8*a* rises. The stop washer 9 strikes against the fixing region 1*c*, deforming the same. This process occurs each time the drive machine is operated. Repeated operation may promote plastic deformation of the fixing region 1*c* to such extent that the inner diameter of the region 1*c* will be smaller than that of the sealing area 1*b*.

To disassemble the driving machine, particularly for removing the cylinder 8 from the body frame 1 for the purpose of maintenance or inspection, the stop washer 9 is first removed by pinching the lip ends 9*a* together, thus, decreasing the diameter of the stop washer 9. As a result, the stop washer 9 can be disengaged from the annular groove 1*a*. The cylinder 8 is therefore, freely movable upwardly for disassembly. If, however, the fixing region 1*c* is plastically deformed such that its inner peripheral portion bulges radially inwardly, and its inner diameter becomes smaller than that of the sealing area 1*b*, the O-ring 10 may abut the bulged portion, enter the groove 1*a*, and obstruct removal of the cylinder 8 from the body frame 1. If excessive force is applied to remove the cylinder, the O-ring 10 may be cut.

SUMMARY OF THE INVENTION

It is therefore, an object of the present invention to overcome the above-described drawbacks, and to provide a driving machine having an improved cylinder fixing arrangement.

Another object of the invention is to provide such driving machine capable of facilitating removal work of a cylinder from a body frame, to thereby facilitate maintenance to the machine.

These and other objects of the present invention will be attained by providing a driving machine for driving a fastener element into a workpiece comprising an outer body frame, a cylinder, a piston and a circular stop washer. The outer body frame has an inner peripheral surface which provides an annular sealing area, an annular groove positioned above the annular sealing area, and an annular fixing region next to the annular groove and at a position thereabove. The cylinder is disposed in the outer body frame. The cylinder is provided with a flange at an axially intermediate portion thereof. The flange has an outer peripheral surface in sealing contact with the annular sealing area. The flange also has an upper surface in alignment with the annular groove. The piston is reciprocally disposed in the cylinder for driving the fastener. The circular stop washer is formed of a resilient material. The stop washer is partly engaged in the annular groove and partly positioned on the upper surface of the flange for preventing the cylinder from moving upward, thereby fixing the cylinder at a position relative to the outer body frame. An inner diameter of the annular fixing region is greater than that of the annular sealing area. Preferably, the annular fixing region is formed with a lower chamfered portion at a boundary of the annular groove, and the flange is formed with an upper chamfered portion.

Even if the fixing region is deformed and its inner diameter is reduced by upwardly urging force of the cylinder, the reduced diameter is still sufficient to allow the flange to pass therethrough after detachment of the stop washer. Even if an O-ring is installed on the outer peripheral surface of the flange to provide a hermetical seal between the flange and the sealing area, the cylinder can be removed from the outer body frame without any accidental entry of the O-ring into the annular groove.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
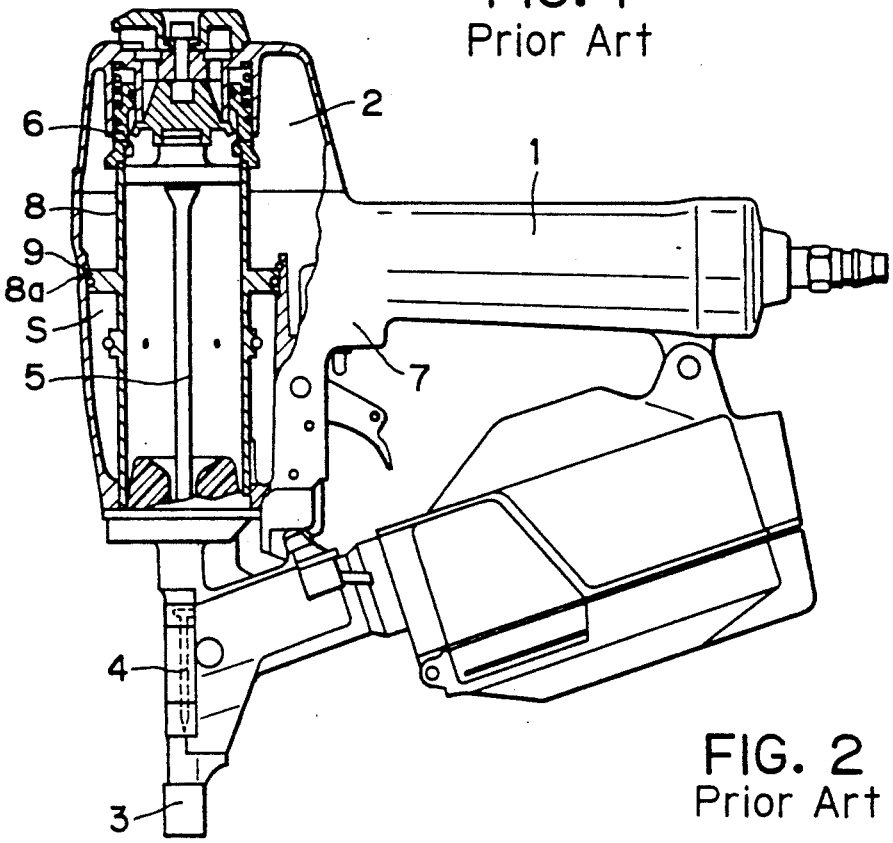
FIG. 1 Prior Art
FIG. 1 is a side view, partially in cross-section, showing a conventional driving machine.
Figure 2:
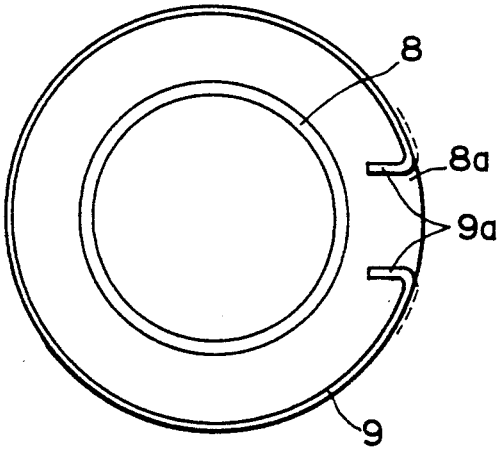
FIG. 2 Prior Art
FIG. 2 is a top plan view showing a conventional cylinder fixing arrangement in the conventional driving machine.
Figure 3:
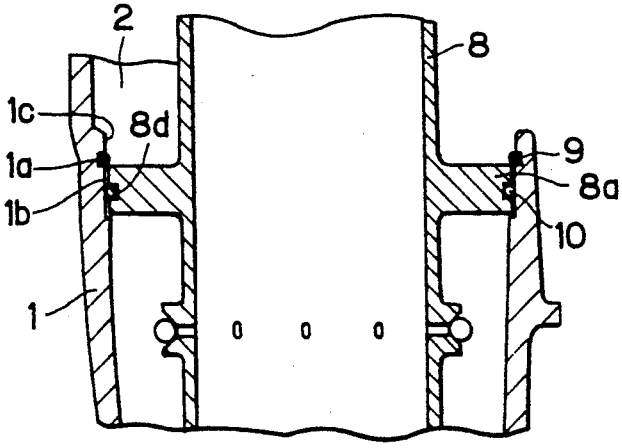
FIG. 3 Prior Art
FIG. 3 is a cross-sectional view showing an essential portion of the conventional cylinder fixing arrangement.

A driving machine having a cylinder fixing arrangement according to a first embodiment of this invention will be described with reference to FIG. 4, wherein like parts and components are designated by the same reference numerals as those shown in FIGS. 1 through 3 to avoid duplicating description.

Figure 4:
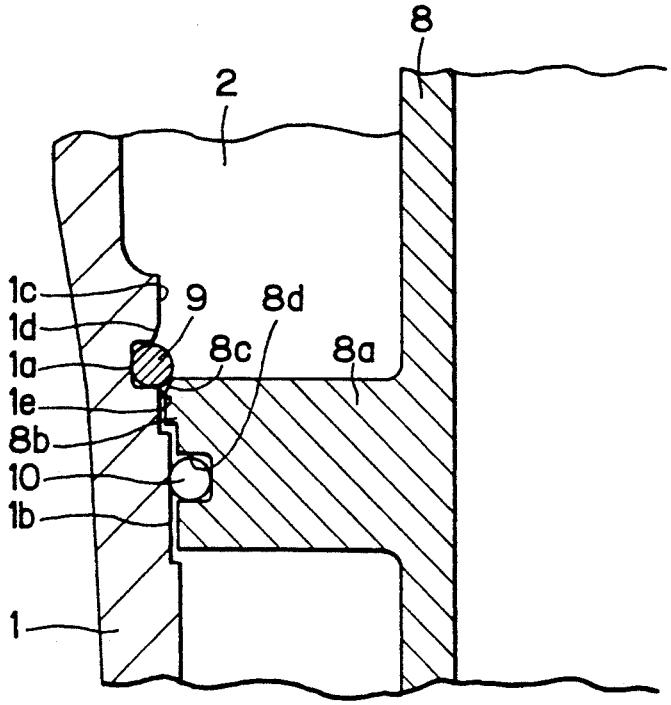
FIG. 4 is a cross-sectional view showing a cylinder fixing arrangement of a driving machine according to a first embodiment of the present invention.

In FIG. 4, an annular protrusion 8*b* protrudes radially outwardly from an outer peripheral surface of the flange 8*a* at an upper position thereof. The annular protrusion 8*b* can also be referred to as a large diameter portion of the flange 8*a*. Further, a top edge of the annular protrusion 8*b* is chamfered to provide a first chamfered portion 8*c*. An outer peripheral surface of the annular protrusion 8*b* confronts and conforms to an inner peripheral surface of the body frame. Here, inner diameters of the confronting portion 1*e* and the fixing region 1*c* are greater than that of the sealing area 1*b*. Furthermore, a lower corner portion, which is a boundary between the annular groove 1*a* and the fixing region 1*c*, is formed with a second chamfer 1*d*.

With this structure, when the cylinder 8 is urged upward due to reaction of the driving operation, a stop washer 9 collides with the second chamfered portion 1*d*. Repeated operation of the driving machine may plastically deform the second chamfered portion 1*d* and reduce its inner diameter. However, since the inner diameter of the second chamfered portion 1*d* is beforehand set greater than that of the sealing area 1*b*, the deformingly reduced inner diameter is still sufficient (still larger than the inner diameter of the sealing area 1*b*) to allow the flange 8*a* to pass therethrough after detachment of the stop washer 9.

In other words, even after the deformation of the second chamfered portion 1*d*, the inner diameter of the second chamfered portion 1*d* is not so greatly reduced. Therefore, abutment of the O-ring 10 with the second chamfered portion 1*d* can be prevented to prevent the O-ring 10 from entering the annular groove 1*a* during disassembly or assembly of the cylinder 8.

Further, the first and second chamfered portions 8*c* and 1*d* allow smooth passage of the flange 8*a* through the fixing region 1*c*, since the first chamfered portion 8*c* can smoothly move past the second chamfered portion 1*d*. Furthermore, since the lower edge of the fixing region 1*c* is the second chamfered portion, chamfered rather than an acute angle, the O-ring 10 does not undergo any damage by the second chamfered portion 1*d* when it is moved past the same.

Figure 5:
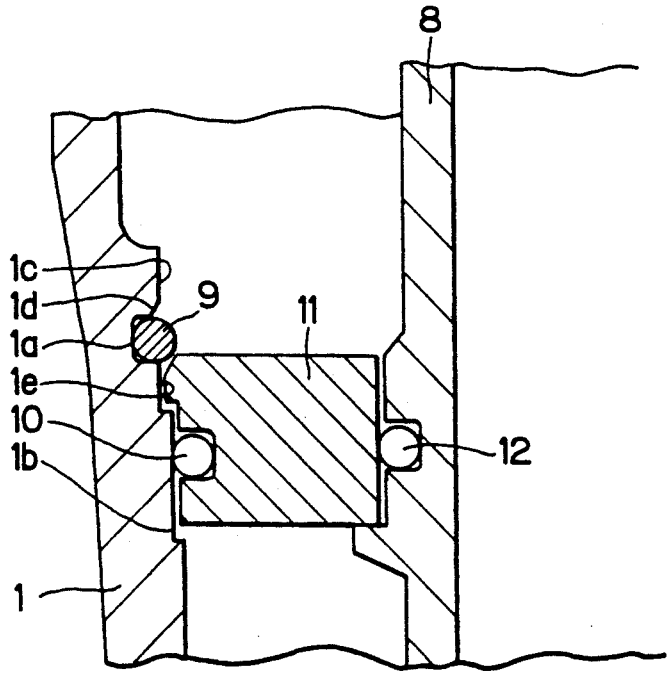
FIG. 5 is a cross-sectional view showing a cylinder fixing arrangement according to a modified or second embodiment of the present invention.

One modified embodiment is shown in FIG. 5. In the first embodiment described above, the flange 8*a* is provided integrally with the cylinder 8. However, in the modified embodiment, the flange is constructed independently as per an annular disc plate 11 as shown in FIG. 5. In this case, a space between the plate 11 and the cylinder 8 must be sealed with an O-ring 12.

While the invention has been described in detail with reference to specific embodiments thereof, it would be apparent to those skilled in the art that various changes and modifications may be made therein without departing from the spirit of the invention.

What is claimed is:

1. A driving machine for driving a fastener element into a workpiece comprising:

an outer body frame having an inner peripheral surface which provides an annular sealing area, an annular groove positioned above the annular sealing area, and an annular fixing region in succession with the annular groove and at a position thereabove, an inner diameter of the annular fixing region being greater than that of the annular sealing area;

a cylinder disposed in the outer body frame, the cylinder being provided with a flange at an axially intermediate portion thereof, the flange having an outer peripheral surface in sealing contact with the annular sealing area, the flange also having an upper surface in alignment with the annular groove;

a piston reciprocally disposed in the cylinder for driving the fastener; and a circular stop washer formed of a resilient material, the stop washer being partly disposed in the annular groove and partly positioned on the upper surface of the flange for preventing the cylinder from upward displacement, to thereby fix the cylinder at a position relative to the outer body frame.

2. The driving machine as claimed in claim 1, wherein the annular fixing region is formed with a lower chamfered portion at a boundary of the annular groove, and wherein the flange is formed with an upper chamfered portion.

3. The driving machine as claimed in claim 2, wherein the flange is provided with an upper annular protrusion protruding radially outwardly from the outer peripheral surface thereof, the upper chamfered portion being positioned at an upper peripheral end of the annular protrusion.

4. The driving machine as claimed in claim 3, wherein the inner peripheral surface of the outer body frame is formed with a mating region in confrontation with the annular protrusion at a position between the annular sealing area and the annular groove, an inner diameter of the mating region being greater than that of the annular sealing area.

5. The driving machine as claimed in claim 4, wherein the outer peripheral surface of the flange is formed with an annular groove, and the driving machine further comprising a sealing ring disposed in the annular groove of the flange and in sealing contact with the sealing area.

6. The driving machine as claimed in claim 5, wherein the flange is provided integrally with the cylinder.

7. The driving machine as claimed in claim 5, wherein the flange is provided independent of the cylinder.

* * * * *